US006203393B1

(12) United States Patent
Flynn

(10) Patent No.: US 6,203,393 B1
(45) Date of Patent: Mar. 20, 2001

(54) TOY

(75) Inventor: John Flynn, St. Martins (NZ)

(73) Assignee: The All-Round Company Limited, Christchurch (NZ)

( * ) Notice: Subject to any disclaimer, the term of this patent is extended or adjusted under 35 U.S.C. 154(b) by 0 days.

(21) Appl. No.: 09/194,656

(22) PCT Filed: May 29, 1997

(86) PCT No.: PCT/NZ97/00067

§ 371 Date: Nov. 30, 1998

§ 102(e) Date: Nov. 30, 1998

(87) PCT Pub. No.: WO97/45181

PCT Pub. Date: Dec. 4, 1997

(30) Foreign Application Priority Data

May 29, 1996 (NZ) ..... 286687

(51) Int. Cl.[7] ..... A63H 17/26

(52) U.S. Cl. ..... 446/75; 446/77; 446/93; 446/95; 446/230

(58) Field of Search ..... 446/75, 76, 77, 446/78, 93, 94, 95, 230, 231

(56) References Cited

U.S. PATENT DOCUMENTS

D. 87,201 * 6/1932 Carroll ..... 446/230
2,975,547 * 3/1961 Greve ..... 446/77
4,593,817 * 6/1986 Ferrero ..... 446/77
4,631,040 * 12/1986 Shiraishi ..... 446/94
4,822,314 * 4/1989 O'Brian et al. ..... 446/77
4,963,115 * 10/1990 Stowell Davin et al. ..... 446/75
5,007,636 * 4/1991 Pagani ..... 446/75
5,545,069 * 8/1996 Glynn et al. ..... 446/76

FOREIGN PATENT DOCUMENTS

485218 * 7/1952 (CA) ..... 446/75
2207363 * 2/1989 (GB) .
9112190 * 8/1991 (WO) .

* cited by examiner

*Primary Examiner*—Jacob K. Ackun
*Assistant Examiner*—Jeffrey D. Carlson
(74) *Attorney, Agent, or Firm*—Fulbright & Jaworski, LLP

(57) ABSTRACT

A toy which includes a hollow spherical body is disclosed. The body is adapted to be dismantled into at least two parts. Component parts are included within the body. These component parts are adapted to be releasably fixed to the exterior of the body to modify the appearance of the body into a car, a truck, a helicopter, aircraft, spaceship, submarine or similar vehicle. A character may also be included within the spherical body.

10 Claims, 3 Drawing Sheets

TOY

FIELD OF INVENTION

This invention relates to a toy. Particularly but not exclusively, this invention relates to a toy including a divisible hollow body, wherein components can be stored within the body and in use are attached to the body in order to modify the appearance of the toy.

BACKGROUND TO THE INVENTION

Toys which transform shape by the addition of different components are not new. However, the components can easily be lost.

It is a object of the present invention to provide a toy which will go some way in overcoming the above disadvantage or which will at least provide the public with a useful alternative choice.

SUMMARY OF INVENTION

According to one aspect of the present invention, there is provided a toy including a hollow body, wherein the body is adapted to be disassembled into two or more parts and wherein one or more components are stored within the body, the components being removably attachable to the outside surface of the body and/or removably attachable to each other so as to modify the appearance of the toy.

In particular the invention provides a toy including a hollow ball, wherein the ball is adapted to be disassembled into two or more parts and wherein one or more components are stored within the ball, the components being removably attachable to the outside surface of the ball and/or removably attachable to each other so as to modify the appearance of the toy.

Part of the body's surface may be removable so as to reveal a transparent portion of the body's surface.

The hollow body may be substantially spherical. The hollow body may include a first and a second part. Preferably, the hollow body is divisible along its equator.

A steering wheel and seat may be affixed to the interior of the second part. Part of the first part's surface may be removable so as to reveal a transparent portion of the body's surface.

The components may be those required to form any type of vehicle. A helicopter is preferred. However, a motor car, crane, digger, truck, submarine, spaceship, aeroplane or the like are also included within the scope of the invention.

The steering wheel and/or chair and the like may also be components in the body.

The components may include wheels, axles, helicopter tail, helicopter skids and/or helicopter rotor and the like. Additionally or alternatively the components may include parts necessary to form a character e.g. head, arms, hands, legs, body.

The invention also provides a toy including a hollow spherical body, the body being adapted to be disassembled into a first part and a second part, wherein at least one component is stored within the hollow body, the at least one component being releasable attachable to the outside surface of the hollow body so as to modify the appearance of the hollow spherical body such that it resembles a car, a helicopter, an aeroplane, a truck, a submarine or a spaceship.

In particular the invention provides a toy including a hollow spherical ball, the ball being adapted to be disassembled into a first part and a second part, wherein at least one component is stored within the hollow ball, the at least one component being releasably attachable to the outside surface of the hollow ball so as to modify the appearance of the hollow spherical ball such that it resembles a car, a truck, a digger, a crane, a helicopter, an aeroplane, a submarine or a spaceship or the like.

Holes may be provided in the surface of the body to allow the components to be affixed to the body.

The ball 1 and components are preferably made from plastics, and the components and/or ball may be painted so they appear metallic. Other materials may be used. All materials should be non-toxic where the toy may be used by young children.

DETAILED DESCRIPTION OF THE DRAWINGS

Further aspects of the invention will become apparent from the following description which is given by way of example only with reference to the accompanying drawings in which.

The present description includes the examples of a helicopter and car. It is to be understood that other variations are contemplated and are to be considered within the scope of one skilled in the art.

Figure 1:
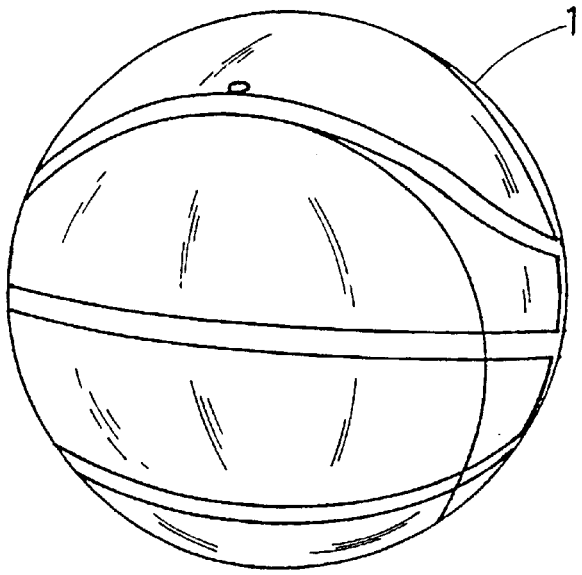
FIG. 1 shows a side view of the hollow body according to one aspect of the present invention.
Figure 2:
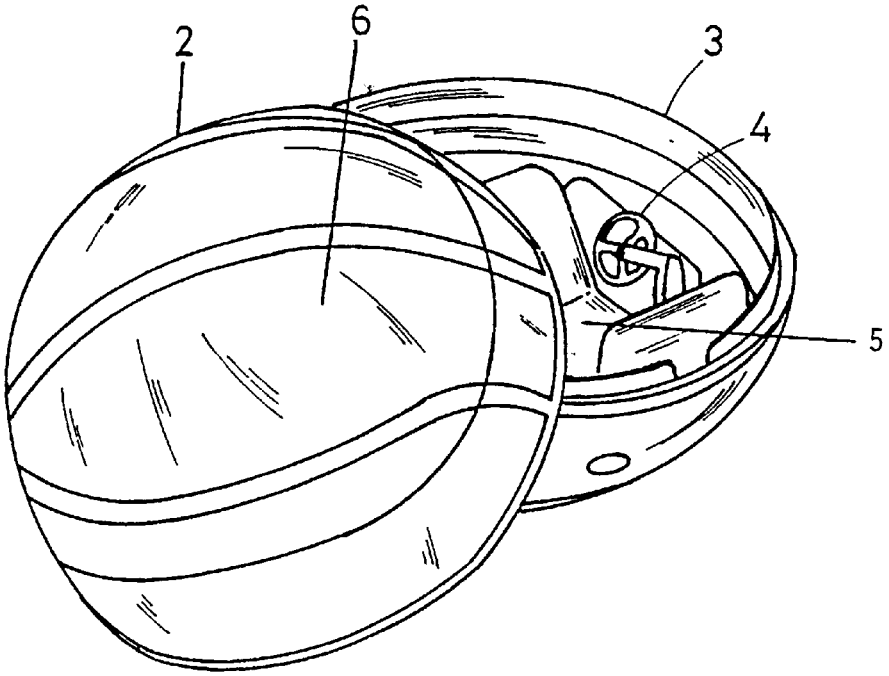
FIG. 2 shows a perspective view of the two parts into which the body can be divided, according to the embodiment shown in FIG. 1.
Figure 3:
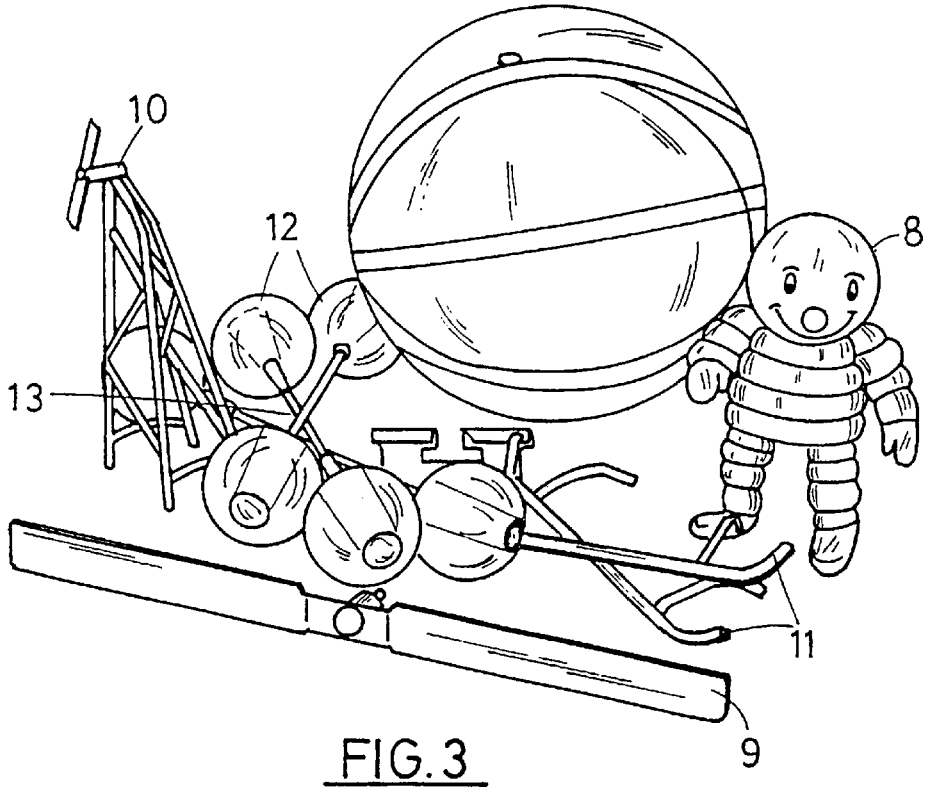
FIG. 3 shows a perspective view of the body and the components which are stored within the hollow body, according to the embodiment shown in FIGS. 1 and 2.

As can be seen in FIGS. 1 and 2, the toy includes a ball 1. The ball 1 is adapted to be divided into a first part 2 and a second part 3. The interior of second part 3 includes a steering wheel 4 and a seat 5.

Figure 4:
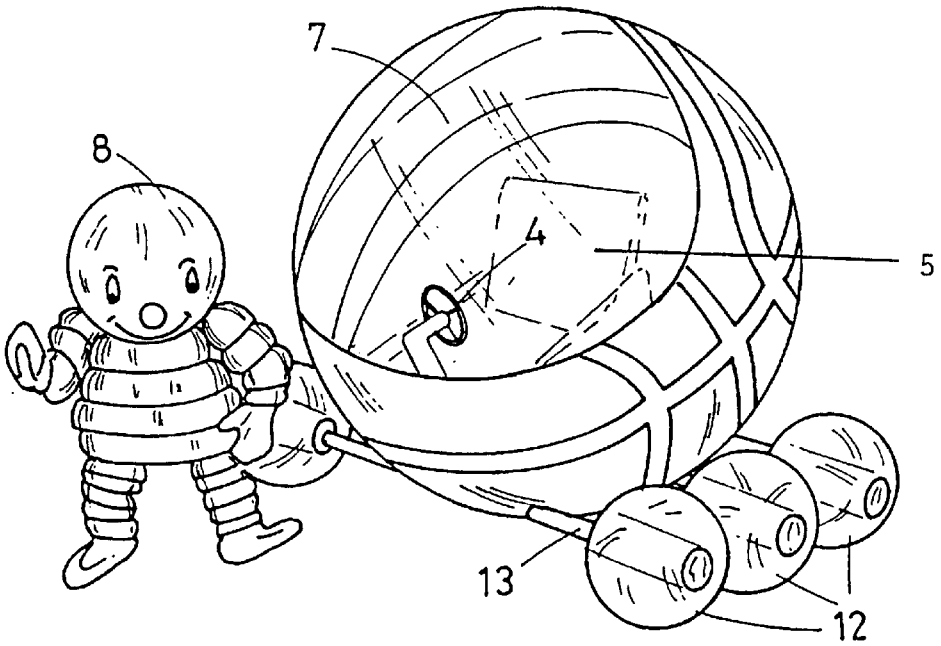
FIG. 4 shows the character and the car version of the toy, according to the embodiment shown in FIGS. 1 to 3.
Figure 5:
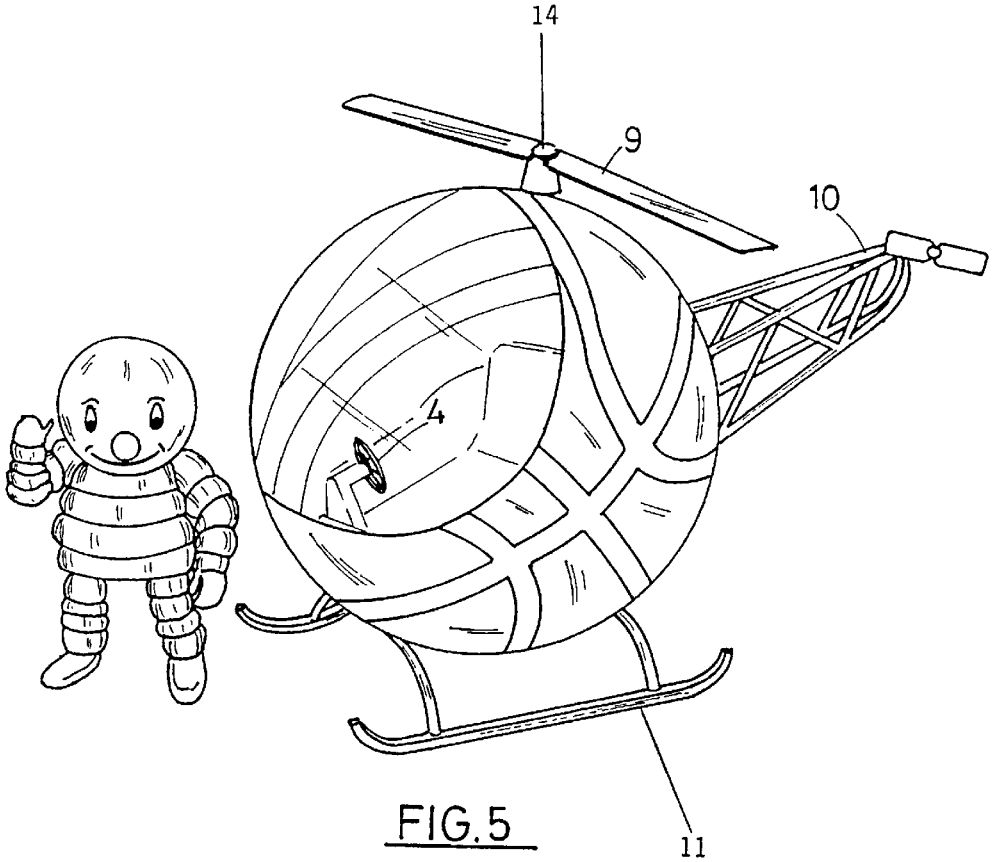
FIG. 5 shows the character and the helicopter version of the toy, according to the embodiment shown in FIGS. 1 to 4.
Figure 6:
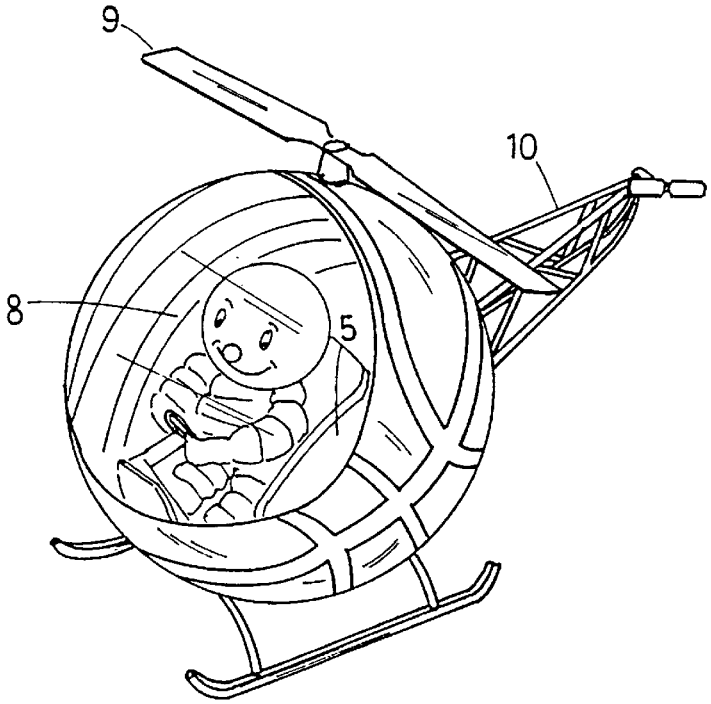
FIG. 6 shows the character inside the helicopter version of the toy, according to the embodiment shown in FIGS. 1 to 5.

The exterior surface of the first part 2 has a portion 6 which, when removed, reveals a transparent section 7 which acts as the windscreen (shown in FIGS. 4 to 6).

Components used to make the helicopter and car vehicles are stored within the ball. The components include the following:

| | |
|---|---|
| helicopter rotor | 9 |
| helicopter tail | 10 |
| helicopter skids | 11 |
| 6 wheels | 12 |
| 3 axles | 13 |

The helicopter rotor 9 is able to be folded about a central point 14, so it fits within the ball.

The components 9–14 are fixed to the ball 1 by means of holes (not shown) provided in ball 1. The components accordingly slide or 'clip' into the holes in a known manner. A false bottom (not shown) is provided in second part 3. In order for the axles 13 to be affixed to the second part 3, the axles 13 slide into holes located on either side of the second part 3 and under the false bottom. The wheels 12 then slide onto the ends of axles 13.

The character 8 is made up from the following parts:

head nose body 2 feet 2 legs 2 hands 4 parts which form 2 arms

The character's joints e.g. shoulder and elbow are movable, so as to allow the character 8 to adopt a variety of poses.

It will thus be seen that the present invention provides a toy which can be converted into a number of vehicles, of which two examples are provided herein. The components which characterise the toy as a particular vehicle may be stored inside the body of the toy for convenience and to avoid loss.

Where in the aforegoing description, reference has been made to integers or components having known equivalents, then such equivalents are herein incorporated as if individually set forth.

Although this invention has been described by way of example and with reference to possible embodiments thereof, it is to be appreciated that improvements and/or modifications may be made thereto without departing from the scope or spirit of this invention.

For example, the components may comprise parts for a vehicle other than a helicopter, such as an aeroplane, car, digger, truck, submarine, or spaceship and the like.

The present invention relates to a toy which provides utility as a plaything.

What is claimed is:

1. A toy including a hollow ball having an equator, wherein the ball is adapted to be disassembled about its equator into two or more parts and wherein one or more components are stored within the ball, the components being removably attachable to the outside surface of the ball and/or removably attachable to each other so as to modify the appearance of the toy, and wherein at least a portion of the ball's exterior surface is removable to reveal a transparent portion of the ball's surface.

2. A toy according to claim 1 wherein the hollow ball is substantially spherical.

3. A toy according to claim 1 in which the components comprise a character or parts necessary to form a character such as head, body, arms, legs.

4. A toy according to claim 1 in which the components comprise a steering wheel and a seat.

5. A toy according to claim 3 in which one of the parts includes a steering wheel and/or a seat attached to its internal surface.

6. A toy according to claim 1 in which the components comprise parts required to form a vehicle such as a car, a helicopter or an airphane when said parts are attached to the exterior surface of the hollow ball.

7. A toy according to claim 6 in which the components include one or several of the following: wheels, axles, helicopter tail, helicopter skids, helicopter rotor, airplane wings, spaceship parts, submarine parts, digger parts, and crane parts.

8. A toy according to claim 6 in which holes are provided in the external surface of the ball, the holes being the means by which the components are attachable to the external surface of the sphere.

9. A toy including a hollow spherical ball, the ball being adapted to be disassembled into a first part and a second part, wherein at least one component is stored within the hollow ball, the at least one component being releasably attachable to the outside surface of the hollow ball so as to modify the appearance of the hollow spherical ball such that it resembles a car, a truck, a digger, a crane, a helicopter, an airplane, a submarine or a spaceship. wherein at least a portion of the ball's exterior surface is removable to reveal a transparent section of the ball's surface.

10. A toy according to claim 9 wherein the hollow spherical ball also includes a character.

* * * * *